United States Patent [19]

Curran

[11] 4,191,158

[45] Mar. 4, 1980

[54] GAS FIRED GUN AND PLASTIC VALVE THEREFOR

[75] Inventor: Roger J. Curran, Stratford, Conn.

[73] Assignee: Bangor Punta Operations, Inc., Greenwich, Conn.

[21] Appl. No.: 797,883

[22] Filed: May 17, 1977

[51] Int. Cl.[2] ..... F41B 11/06

[52] U.S. Cl. ..... 124/76; 124/74; 251/339; 251/368; 264/22; 264/130; 264/275

[58] Field of Search ..... 124/70, 73, 74, 75, 124/76, 77; 251/321, 336, 339, 368; 264/22, 130, 275

[56] References Cited

U.S. PATENT DOCUMENTS

| | | | |
|---|---|---|---|
| 2,055,601 | 9/1936 | Dodge | 251/321 X |
| 3,058,718 | 10/1962 | Johnson | 251/321 X |
| 3,166,292 | 1/1965 | Forman | 251/368 X |
| 3,607,380 | 9/1971 | Thams | 264/130 X |
| 3,734,457 | 5/1973 | Roos | 251/368 X |
| 3,824,981 | 7/1974 | Crane et al. | 124/76 |
| 4,076,790 | 2/1978 | Lind | 264/275 X |
| 4,101,699 | 7/1978 | Stine et al. | 264/22 X |
| 4,116,193 | 9/1978 | Chiba | 124/76 X |

*Primary Examiner*—Richard T. Stouffer
*Attorney, Agent, or Firm*—Patrick J. Walsh

[57] ABSTRACT

The plastic valve includes an elongated plastic valve stem and an elongated pin. An end portion of the pin projects from an end of the plastic stem with the remaining portion of the pin being wholly encapsulated by the stem. The pin is generally cylindrical and has a pair of reduced diameter portions defining shoulders forming impact surfaces which butt the axially opposed portions of the encapsulating stem. The stem preferably has a tapered sealing surface irradiated by beta rays to provide a sealing surface highly resistant to creep and deformation. The sealing surface is coated with Fluorocarbon Polymer to reduce its chemical activity and to improve its sealing characteristics. The opposite end of the pin serves as a deflector opposite the molding gate to control the flow of plastic material during injection molding of the stem to prevent weld lines on the seal surface.

28 Claims, 9 Drawing Figures

GAS FIRED GUN AND PLASTIC VALVE THEREFOR

The present invention relates to a gas fired BB or pellet type gun and particularly to a plastic valve for use in such gas fired gun having improved structural and operational characteristics.

Gas fired guns, as opposed to spring fired guns depend upon release of stored energy in a gas through a valve system. For example, the momentary release of the gas or entire venting of gas from an accumulator serves to propel a pellet or BB along the gun barrel and from the gun. Momentary release of gas is usually achieved in the valve system by a hammer striking a valve stem which, in turn, opens the valve. After delivery of a volume of gas at specified pressure, internal springs within the valve close the valve in preparation for the next shot.

A number of problems are associated with this type of valve system in gas fired guns. The most important problem associated with this system is that the valve, which must reliably operate tens of thousands of times repeatedly, must also seal gas continuously at high pressure and, in some instances at high storage temperature conditions for long periods of time. The combined effect of time, temperature and pressure during the storage period, however, can result in deformation of the valve's sealing surfaces. It will be appreciated that the valve sealing surfaces used in gas fired guns are conventionally constructed of two confronting surfaces, one of which is formed of hard material while the other is formed of more resilient and compliant material. The compliance of the latter material is necessary to seal about imperfections in the surface of the harder material and also to seal about foreign particles, such as dirt, which may be trapped between the seal surfaces when the valve is closed. Also, the pressure in the valve system of a $CO_2$ powered gun is normally in the range of 900 psi. The temperature of the gas in storage may, however, rise to 150° F. This in turn can increase the pressure of the $CO_2$ to 2000 psi and above depending upon the internal volume and the quantity of gas still remaining in the cartridge. The high pressure and temperature conditions act on the valve seat and can cause creep or sustained deformation of the sealing surface. That is, because of these high temperature and pressure conditions, the sealing surface material can undesirably flow. This flow, occurring as a result of creep of the sealing surfaces, can result in a permanent deformation of the valve seat. This, in turn, changes the set of the valve and its opening and closing characteristics thereby altering the quantity of gas which is released on each firing and the velocity obtained by the projectile when fired from the gun.

Another problem with valve sealing surfaces in this environment is associated with the transfer of material mechanically from one valve surface to the other or by abrasion and subsequent loss of valve seat material out the gas flow stream. This problem results from the natural affinity of two unlike materials. Since these two materials are brought into intimate, high pressure contact one with the other and then separated, an adherence between the two materials occurs which, when broken, may result in a fracture in one of the materials. For example, in one known plastic valve system, zinc particles from the valve seat deposited themselves onto the surface of the plastic valve stem. These zinc particles became embedded in the plastic valve stem and this together with the continuing deposition of the zinc particles on the stem caused the valve to fail.

A further problem concerns the accumulation of dirt particles on the valve seat during valve closing. These dirt particles come from the gas stream itself and are trapped between the seat surface upon closing the valves. Although filters are used to avoid such dirt particle accumulation, which also wears and abrades the valve surfaces, there is a practical limit to the size of particles which can be filtered.

Present valve systems for gas fired guns use a urethane rubber type seal working against an annular surface. The rubber seal comprises an annular gasket which is fitted into a brass body forming the valve stem. A steel pin is usually press fitted into the brass valve stem. This structure consisting of three different materials which must be assembled results in secondary problems besides the one of high cost. One such problem is that the assembly can result in deformation of the gasket surface in such a way that a warp obtains at the seal surface. Thus, a significant deformation of the gasket is required before sealing can actually take place and necessitates the use of relatively flexible type rubber materials.

Another form of valve system used presently in this art is a machined plastic stem made from high molecular weight high density polyethylene and which is subsequently attached to the main valve stem pin by a rolling operation. In this case, the machining leaves a rough fuzzy surface which is not conducive to good sealing and can result in a warped or distorted seal surface. In addition, the assembly introduces gas leakage paths through the center of the machined plastic part. Because of the impact forces which this system must sustain during normal operation, the assembly often breaks down causing failure of the valve. The metal pin used in these assemblies must be of a complex design to avoid such failures since it extends through the valve body with no seal and gas can be lost through the gap between the stem and the valve body if the machining of this metal pin results in excessive clearances.

Accordingly, it is a primary object of the present invention to provide a novel and improved plastic valve for gas fired guns.

It is another object of the present invention to provide a novel and improved plastic valve for gas fired guns having a high degree of repeatability in valve closing characteristics.

It is still another object of the present invention to provide a novel and improved plastic valve for gas fired guns wherein the resilient sealing surfaces of the valve are highly resistant to permanent deformation and creep.

It is a further object of the present invention to provide a novel and improved plastic valve for gas fired guns having high impact resistance surfaces between the pin and the plastic stem, the pin being formed of metal and projecting from the stem for striking by a hammer to fire the gun.

It is a still further object of the present invention to provide a novel and improved plastic valve for gas fired guns wherein the majority of the pin is completely encapsulated by the plastic stem with the pin having a deflector surface at one end to control the flow of plastic during injection molding so as to avoid molding defects on the seal surfaces.

It is a related object of the present invention to provide a novel and improved plastic valve for gas fired guns wherein the stem is formed of a material having a surface which is resilient, tough, and creep resistant.

Additional objects and advantages of the invention will be set forth in part in the description which follows and in part will be obvious from the description or may be learned by practice of the invention. The objects and advantages of the invention may be realized and obtained by means of the instrumentalities and combinations particularly pointed out in the appended claims.

To achieve the foregoing objects and in accordance with the purpose of the invention, as embodied and broadly described herein, the apparatus of the present invention comprises a gun frame, a barrel carried by the gun frame, means carried by the frame defining a chamber for containing a gas under pressure, a normally closed valve carried by the frame for storing gas in the chamber under pressure, means carried by the frame for opening the valve and releasing gas from the chamber to propel the projectile along the barrel, the valve including a valve seat, an elongated valve stem and an elongated pin carried by the stem, the pin having an end portion projecting from one end of the stem, the stem being formed of a plastic material wholly encapsulating the remaining portion of the pin, the stem having a sealing surface adjacent the one stem end engageable with the valve seat, the pin being generally cylindrical throughout its length and having a different diameter portion in the remaining pin portion defining a shoulder axially spaced from the projecting end portion of the pin, the shoulder lying wholly within the stem and facing a direction opposite to the direction the pin end portion projects from the stem, the end of the pin opposite its projecting end portion terminating within the stem short of the opposite end of the stem whereby the opposite pin end and the shoulder form impact surfaces within the stem butting the axially opposed portions of the stem encapsulating the remaining portion of the pin.

Preferably, the pin has a pair of reduced diameter portions along the portion of the pin encapsulated within the stem and which reduced diameter portions define a pair of shoulders providing impact surfaces butting axially opposed portions of the stem. These reduced diameter portions also define a pair of shoulders facing the end of the pin which projects from the stem and which shoulders serve to retain the pin within the stem. The pin may have other forms of impact surfaces such as knurled, threaded, or flanged surfaces, or transverse bores through the pin. Further, the stem is formed of a plastic material having a sealing surface which is irradiated with beta ray radiation to form a creep and deformation resistant surface. This surface is coated with Teflon to reduce its chemical activity, seal minor imperfections in the surface, and enable encapsulation of any embedded particle accumulation.

These and other features and advantages of the present invention will become more apparent from the following description, appended claims and drawings wherein:

Reference will now be made in detail to the present preferred embodiment of the invention, an example of which is illustrated in the accompanying drawings.

Figure 1:
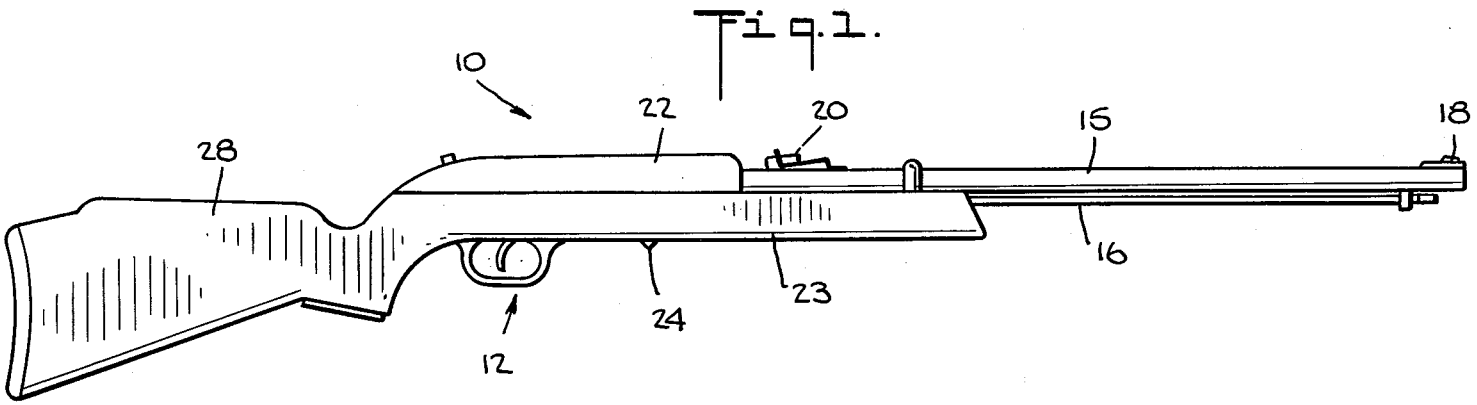
FIG. 1 is a side elevational view of a gun having a novel and improved plastic valve constructed in accordance with the present invention.
Figure 9:
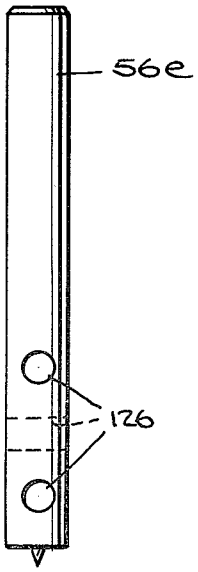
FIGS. 6 through 9 illustrate in side elevation modified forms of impact and retention surfaces for valve pins according to the invention.
Figure 8:
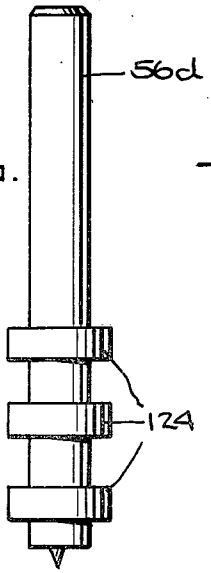
Figure 7:
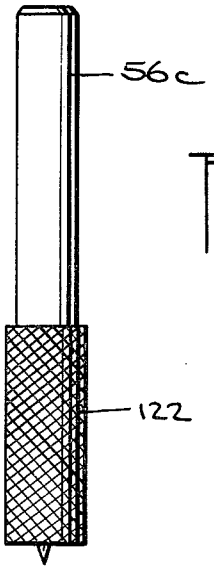
Figure 6:
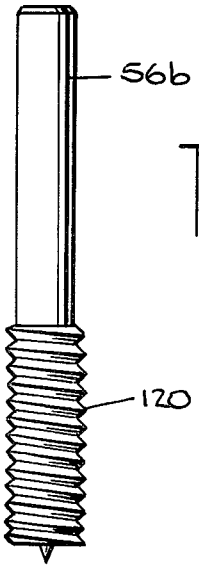

Referring now to the drawings, particularly to FIG. 1, there is illustrated a gun, generally designated 10, containing a trigger mechanism designated 12, a barrel 14 (FIG. 2) within a barrel shroud 15, a magazine tube 16 underlying barrel 14 and barrel shroud 15 for housing individual projectiles, i.e. BB shot, a front sight 18 and a rear sight 20 both mounted on barrel shroud 15, a receiver or frame 22, a stock 23, and a butt 28.

Figure 2:
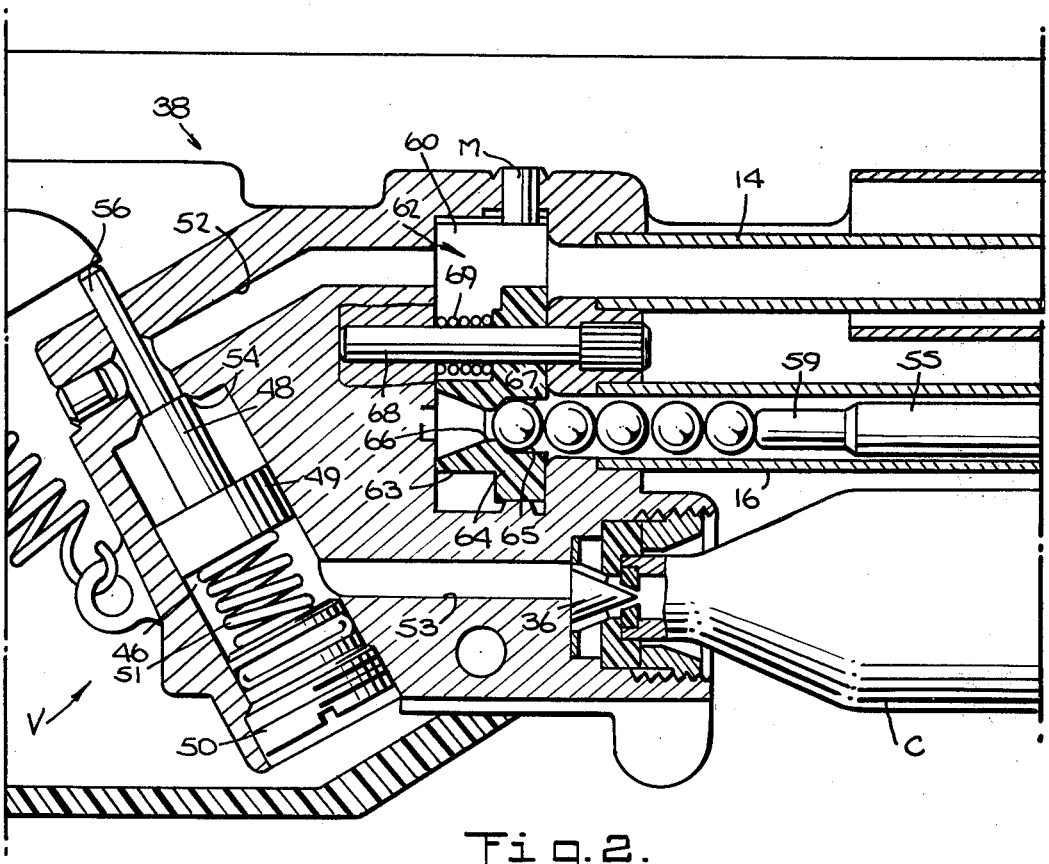
FIGS. 2 and 3 are enlarged fragmentary longitudinal cross sectional views illustrating the valve system of the gas fired gun with the loader therefor being illustrated in alignment with the magazine tube and in alignment with the barrel in FIGS. 2 and 3, respectively.

It will be appreciated and with reference to FIG. 2 that trigger mechanism 12, through a suitable linkage, not shown serves to raise a hammer H against the bias of a spring S which then is released for impact on a firing pin 56 forming part of the valve assembly of the present invention generally designated V. Since the linkage for raising hammer H in response to actuation of the trigger can be accomplished in a variety of different and known ways, further description of that linkage is not believed necessary.

Generally, valve assembly V cooperates with trigger assembly 12, a loader designated 62 and a source of gas under pressure to propel a projectile P along barrel 14. Particularly valve V includes a valve chamber 46 in which is disposed a valve stem 48 spaced from a valve plug or body 50 by a spring 51. The upper end of valve stem 48 normally seals against the valve body under the bias of spring 51 about an inlet port or sealing surface 54 sealing chamber 46 from a passageway 52 in communication with the gun barrel. Valve stem 48 has a base 49 which is polygonal in cross sectional shape to enable gas from cartridge C to pass through a passageway 53 into chamber 46 and beyond base 49 into passageway 52 when valve stem 48 is momentarily depressed against the bias of spring 51 breaking the seal at port 54. As illustrated, valve stem 48 includes a pin 56 which projects outwardly of the valve body whereby stem 48 can be momentarily depressed upon impact by hammer H.

A chamber 60 is also provided in valve body 38 for housing a projectile or BB shot loader, generally designated 62. Loader 62 transfer the projectile or BB shot from magazine 16 into a firing position in alignment with barrel 14 at its breach end in response to a retraction of the trigger. Loader 62 includes a loader arm 64 having a through passage 65. Passage 65 has an intermediate reduced neck 66 defining a cavity 67 on the forward side of arm 64 for receiving the rearmost BB shot in magazine tube 16 as illustrated in FIG. 2. Magazine 16 carries a pushrod 55 which is biased by a spring, not shown, for movement toward the rearmost end of tube 16 to bias projectiles within magazine tube 16 rearwardly for reception in cavity 67 of loader arm 64. Loader arm 64 is biased into alignment with magazine tube 16 by a spring 69. Loader arm 64 pivots about shaft 68 against the bias of spring 69 into the position illustrated in FIG. 3 aligning passage 65, with the BB shot in cavity 65, in a firing position in registry with barrel 14 and valve passageway 52 in response to actuation or squeezing of the trigger. A magnet M is located to retain the BB shot in firing position within cavity 67 preventing it from rolling outwardly of barrel 14 when the loader arm 65 is aligned with barrel 14 as illustrated in FIG. 3.

Figure 3:
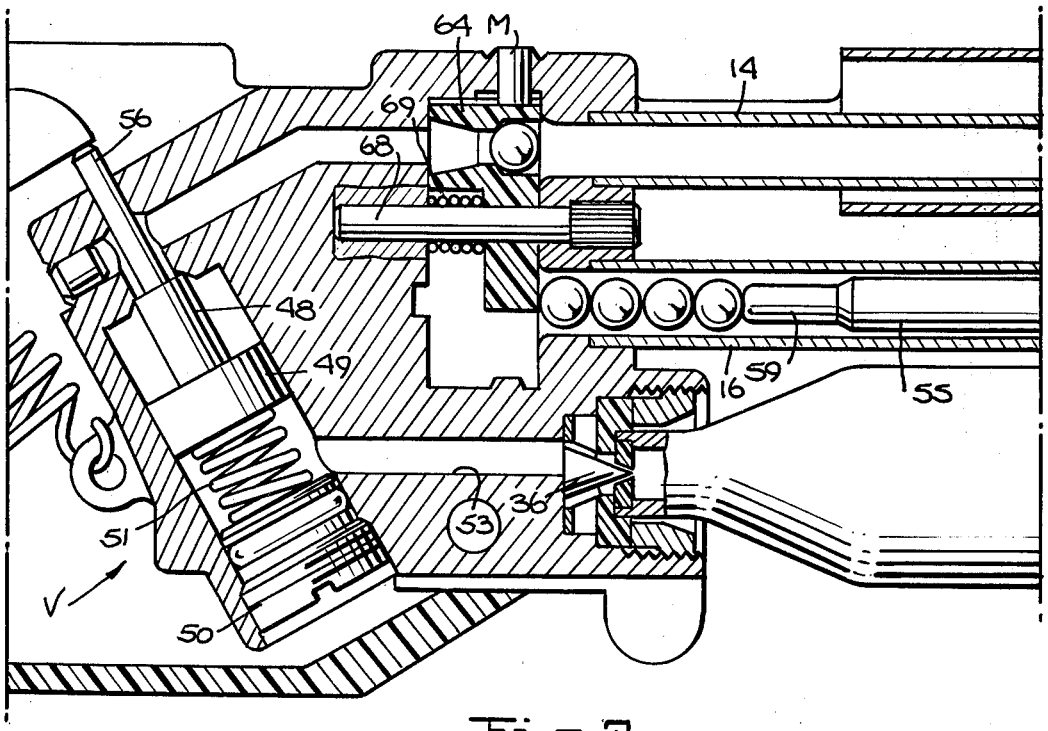

The mechanism interconnecting the trigger and the loader arm 65 does not form part of the present invention and it will be appreciated that various types of mechanism can be employed to pivot loader arm 65 between the positions illustrated in FIGS. 2 and 3. Further description of such mechanism is not believed necessary.

The receiver 22 within stock 23 carries a chamber for receiving a cartridge C containing a gas under pressure. An end of cartridge C, when in the chamber, is received in a puncturing or piercing device 36. A cam lever, not shown, carried by receiver 22 serves to displace the cartridge C toward the puncture device 36. This displacement causes the puncturing device 36 to puncture the end of the cartridge and enables flow of gas into valve chamber 46 via passage 53.

Figure 4:
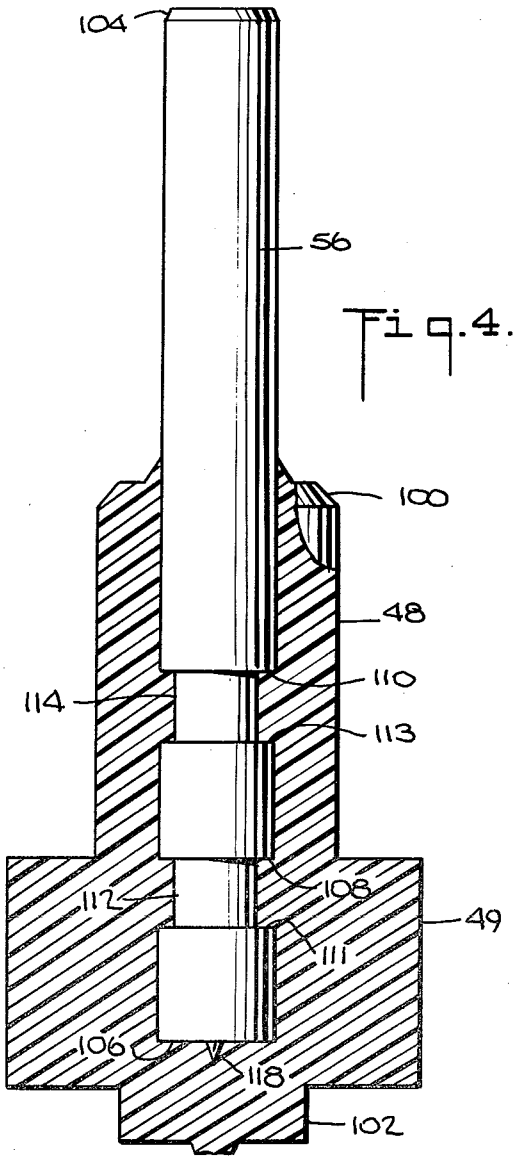
FIG. 4 is an enlarged longitudinal cross sectional view through the valve stem and portions of the valve body particularly illustrating the construction of the pin and stem.

Referring now particularly to FIG. 4 which illustrates the plastic valve of the present invention, valve stem 48 comprises a generally elongated body having a tapered or bevelled sealing surface 100 at one end and a reduced diameter axial projection 102 at its opposite end serving as a retainer for spring 51. Intermediate its opposite ends, valve stem 48 is laterally enlarged and which enlargement 49 is polygonal in cross section 49 in a plane normal to the long axis of the valve stem. The enlarged polygonal cross section is preferably square for reception within the cylindrical valve chamber 46. It will be appreciated that the apices of the polygonal or square sides serve as guides for movement of valve stem 48 along the walls defining chamber 46. Thus, the sides of the laterally enlarged portion 49 between the apices are spaced from the cylindrical side walls of the chamber to enable gas to flow from the lower side of the stem to its upper opposite side.

It is preferred that the upper surface of the valve stem 48 have a conically tapered sealing surface 100. This provides for self-stabilization of the valve toward the end of its sealing movement thus assuring complete and effective seating of the conically tapered sealing surface 100 against similarly conically tapered valve seat 54.

Pin 56 is preferably formed of hardened commercial drill rod and comprises an elongated generally cylindrical member having a tapered upper end 104. Pin 56 is inserted into an injection molding machine whereby the plastic material of the valve stem 48 is flowed about the major portion of the length of pin 56 substantially wholly encapsulating such major portion. To improve the reliability of this valve stem, the end 106 of the pin 56 terminates short of the lower end of valve stem 48 providing a large, generally circular, area which serves as an impact surface opposite opposed portions of the plastic valve stem 48. Pin 56 is provided with a reduced diameter deflector 118 which projects axially from the end 106 of the pin. Deflector 118 facilitates flow of the plastic stem material about the pin during injection molding of the stem.

In view of the necessity to transfer the impact of hammer H on pin 56 to the spring 51 through valve stem 48 without fracturing the plastic valve stem, additional impact surfaces are provided whereby the loading on the valve stem is further distributed throughout the plastic material. To provide such additional impact surfaces, the pin, along the length thereof wholly encapsulated within the plastic material of valve stem 48, is provided with different diameter portions defining an additional shoulder or shoulders. In the present and illustrated embodiment, two additional shoulders or impact surfaces 108 and 110 are provided. More particularly and in the preferred form of the invention, these impact shoulders 108 and 110 are provided by forming the pin with two reduced diameter portions 112 and 114, respectively. Thus, when hammer H impacts on the upper projecting end portion of pin 56, annular surfaces 108 and 110 as well as the circular surface 106 distribute the loading throughout the plastic valve stem 48 and thus prevent the formation of cracks or fractures within the plastic material forming the valve stem 48. Reduced diameter portions 112 and 114 also define shoulders 111 and 113, respectively, in axially spaced opposition to shoulders 108 and 110. These shoulders 111 and 113 assist to retain the pin within the stem 48.

Other forms of impact and retention surfaces may be used. For example, as shown in FIGS. 6 through 9 the the external surface of the pin **56*b–e* may be threaded 120, knurled 122 or may be fitted with protruding flanges 124 of greater diameter than the pin. Additionally, the pin may have transverse bores 126** serving as impact surfaces.

In order to ensure that the plastic material flows evenly to the seal surface 100, the injection molding gate location is placed axially in line with the pin 56 and opposite face 106 which serves to deflect the flow of plastic and to fill the part uniformly and progressively from the gate to the seal surface. This is necessary to avoid molding defects such as weld lines which would affect the seal surface. Air displaced by the plastic flow is vented out of the mold via an annular path formed by the loose fit of pin 56 with the mating mold surfaces. Adequate venting of the air is necessary to ensure proper fill and to avoid chemical decomposition of the surface of the plastic which would result if high pressure, high temperature air came into contact with the high temperature plastic.

Preferably, valve stem 48 is formed of a high density, high molecular weight polyethylene polymer. For example, the polyethylene may be of the type identified as Phillips "Marlex BHB–5012" having a density of 0.950 grams per cubic centimeter and a melt index of 1.2.

Because a material such as this is compounded for easy processing by injection molding, its molecular weight is not sufficient to develop the needed creep resistance required of the valve stem when the stem is exposed to high pressures and to high storage temperature conditions. To develop the required creep resistance the valve sealing surface 100 is irradiated with high energy beta rays. For example, 50 mega roentgens may be applied. This radiation bombardment chemically cross-links the polyethylene locally into a material which is much more resistant to creep by generating in situ a very high molecular weight polyethylene.

Alternatively, the valve stem 48 may be formed of a fluorocarbon resin known as Dupont "Tefzel-210". This material must be injection molded at much higher temperatures than the polyethylene materials and as a result has good high temperature properties and does not require the radiation treatment.

After irradiation with beta rays, if required, at least the sealing surface 100 is coated with a fluorocarbon polymer, such as Miller-Stephenson MS-122 fluorocarbon release agent. This coating provides a very low friction surface whereby particles are easily blown off. It also reduces the chemical activity of the surface after irradiation with beta rays and seals minor imperfections. Further, the fluorocarbon polymer coating encapsulates any embedded particles and ensures that the sealing surface remains clean.

Figure 5:
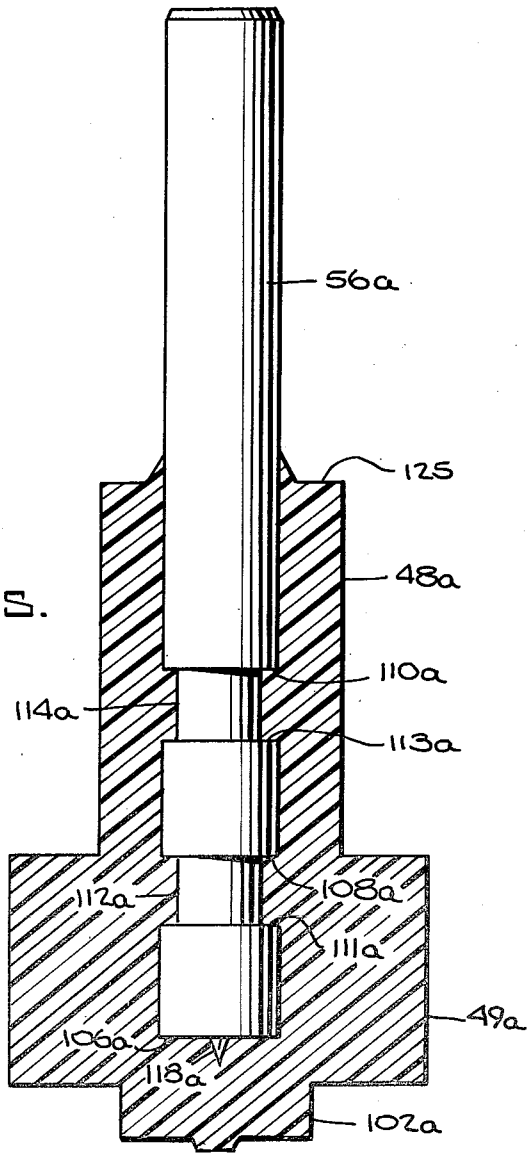
FIG. 5 is a view similar to FIG. 4 illustrating another form of the present invention.

Referring now to the alternate embodiment of the valve stem and pin illustrated in FIG. 5, like parts of the valve stem and pin as described and illustrated with respect to the valve stem and pin illustrated in FIG. 4 are designated with like reference numerals followed by the letter suffix a. In this form, however, the upper end of the valve stem 48*a* has a flat annular sealing surface 215. The seat about port 54 for the sealing surface 125 is likewise flat or may have an annular but flat faced projection.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. Apparatus for propelling a projectile from a gun comprising:

a gun frame, a barrel carried by said gun frame, means carried by said frame defining a chamber for containing a gas under pressure, a normally closed valve carried by said frame for storing gas in said chamber under pressure, means carried by said frame for opening said valve and releasing gas from said chamber to propel the projectile along said barrel, said valve including a valve seat, an elongated valve stem and an elongated pin carried by said stem, said pin having an end portion projecting from one end of said stem, said stem being formed of a plastic material wholly encapsulating the remaining portion of said pin, said stem having a sealing surface adjacent said one stem end engageable with said valve seat, said pin being generally cylindrical throughout its length and having a different diameter portion in said remaining pin portion defining a shoulder axially spaced from the projecting end portion of said pin, said shoulder lying wholly within said stem and facing in a direction opposite to the direction said pin end portion projects from said stem, the end of said pin opposite its projecting end portion terminating within said stem short of the opposite end of said stem whereby said opposite pin end and said shoulder form impact surfaces within said stem butting the axially opposed portions of said stem encapsulating the remaining portion of said pin, and the end of said pin within said stem having a reduced diameter deflector portion projecting axially from said opposite pin end to facilitate flow of plastic material about the pin during injection molding of said stem with said pin.

2. Apparatus according to claim 1 wherein said remaining portion of said pin has a portion defining a second shoulder facing in a like direction as the first mentioned shoulder, whereby said second shoulder forms an impact surface within said stem butting axially opposed portions of said stem.

3. Apparatus according to claim 2 wherein said remaining pin portion has a pair of axially spaced, reduced diameter, portions defining said first and second shoulders.

4. Apparatus according to claim 1 wherein said seal surface is conically tapered.

5. Apparatus according to claim 1 wherein said stem has a portion polygonal in cross section in a plane through said stem normal to the axis of said pin, said chamber being defined by generally cylindrical walls with apices of said stem portion bearing along said walls whereby the polygonal sides of said stem are spaced from the chamber walls to provide gas passages between the opposite ends of said stem.

6. Apparatus according to claim 1 wherein the sealing surface of said stem is irradiated with beta rays.

7. Apparatus according to claim 6 including a fluorocarbon polymer coating over said irradiated sealing surface.

8. Apparatus according to claim 1 wherein said pin has another shoulder along the portion thereof encapsulated within said stem, said other shoulder facing in the same direction as the direction said pin end portion projects from said stem to facilitate retention of said pin in said stem.

9. Apparatus according to claim 1 wherein said seal surface is annular and lies wholly within a plane normal to the axis of said pin.

10. Apparatus according to claim 1 wherein said remaining portion of said pin has a portion defining a second shoulder facing in a like direction as the first mentioned shoulder, whereby said second shoulder forms an impact surface within said stem butting axially opposed portions of said stem, said remaining pin portion having a pair of axially spaced, reduced diameter, portions defining said first and second shoulders, said reduced diameter portions forming third and fourth shoulders respectively facing in the same direction as the direction said pin end portion projects from said stem to facilitate retention of said pin in said stem.

11. Apparatus according to claim 1 wherein said remaining portion of said pin has a portion defining a second shoulder facing in a like direction as the first mentioned shoulder, whereby said second shoulder forms an impact surface within said stem butting axially opposed portions of said stem, said remaining pin portion having a pair of axially spaced, reduced diameter, portions defining said first and second shoulders, said reduced diameter portions forming third and fourth shoulders respectively facing in the same direction as the direction said pin end portion projects from said stem to facilitate retention of said pin in said stem, said seal surface being conically tapered.

12. Apparatus according to claim 1 wherein said remaining portion of said pin has a portion defining a second shoulder facing in a like direction as the first mentioned shoulder, whereby said second shoulder forms an impact surface within said stem butting axially opposed portions of said stem, said remaining pin portion having a pair of axially spaced, reduced diameter, portions defining said first and second shoulders, said reduced diameter portions forming third and fourth shoulders respectively facing in the same direction as the direction said pin end portion projects from said stem to facilitate retention of said pin in said stem, said stem having a portion polygonal in cross section in a plane through said stem normal to the axis of said pin, said chamber being defined by generally cylindrical walls with said stem portions bearing along said walls whereby the polygonal sides of said stem are spaced from the chamber walls to provide gas passages between the opposite ends of said stem.

13. Apparatus according to claim 1 wherein said remaining portion of said pin has a portion defining a second shoulder facing in a like direction as the first mentioned shoulder, whereby said second shoulder forms an impact surface within said stem butting axially opposed portions of said stem, said remaining pin portion having a pair of axially spaced, reduced diameter, portions defining said first and second shoulders, said reduced diameter portions forming third and fourth shoulders respectively facing in the same direction as the direction said pin end portion projects from said stem to facilitate retention of said pin in said stem, the sealing surface of said stem being irradiated with beta rays.

14. Apparatus according to claim 1 wherein said remaining portion of said pin has a portion defining a second shoulder facing in a like direction as the first mentioned shoulder, whereby said second shoulder forms an impact surface within said stem butting axially opposed portions of said stem, said remaining pin portion having a pair of axially spaced, reduced diameter, portions defining said first and second shoulders, said reduced diameter portions forming third and fourth shoulders respectively facing in the same direction as the direction said pin end portion projects from said stem to facilitate retention of said pin said stem, a Teflon coating over said sealing surface.

15. Apparatus for propelling a projectile from a gun comprising:

a gun frame, a barrel carried by said gun frame, means carried by said frame defining a chamber for containing a gas under pressure, a normally closed valve carried by said frame for storing gas in said chamber under pressure, means carried by said frame for opening said valve and releasing gas from said chamber to propel the projectile along said barrel, said valve including a valve seat, an elongated valve stem and an elongated pin carried by said stem, said pin having an end portion projecting from one end of said stem, said stem being formed of a plastic material wholly encapsulating the remaining portion of said pin, said stem having a sealing surface adjacent said one stem end engageable with said valve seat, said pin being generally cylindrical throughout its length and having a first impact surface in said remaining pin portion axially spaced from the projecting end portion of said pin, siad impact surface lying wholly within said stem and cooperating with the stem to transfer impact forces from the pin to the stem, the end of said pin opposite its projecting end portion terminating within said stem short of the opposite end of said stem whereby said opposite pin end forms an additional impact surface within said stem butting the axially opposed portion of said stem, and the end of said pin within said stem having a reduced diameter deflector portion projecting axially from said opposite pin end to facilitate flow of plastic material about the pin during injection molding of said stem with said pin.

16. An apparatus as defined in claim 15 in which said first impact surface is knurled.

17. An apparatus as defined in claim 15 in which said first impact surface is threaded.

18. An apparatus as defined in claim 15 in which said first impact surfaces comprise a phlange.

19. An apparatus as defined in claim 15 in which said first impact surfaces comprise a tranverse bore.

20. An apparatus as defined in claim 15 in which the stem is provided with a plurality of spaced guide surfaces bearing against said chamber, and gas passages intermediate said guide surfaces for flow of gas through said chamber.

21. An apparatus as defined in claim 15 in which the stem is provided with a guide surface bearing against said chamber, and gas passage spaced from said guide surface for flow of gas through said chamber.

22. An apparatus as defined in claim 15 in which the stem is provided with a gas surface bearing against said chamber.

23. Apparatus according to claim 15 in which the stem is formed of high temperature resistant fluorocarbon resin.

24. An apparatus according to claim 23 in which the sealing surface of the stem is irradiated with beta rays.

25. An apparatus according to claim 24 in which the sealing surfaces of the stem is coated with fluorocarbon polymer.

26. An apparatus according to claim 15 in which the stem is injection molded from high density polyethylene.

27. An apparatus according to claim 26 in which the sealing surface of the stem is irradiated with beta rays.

28. An apparatus according to claim 27 in which the sealing surface is coated with fluorocarbon polymer.

* * * * *